US008841532B2

(12) United States Patent
Shir

(10) Patent No.: US 8,841,532 B2
(45) Date of Patent: Sep. 23, 2014

(54) PIANO KEY SYSTEM

(71) Applicant: Gregory Shir, Los Angeles, CA (US)

(72) Inventor: Gregory Shir, Los Angeles, CA (US)

( * ) Notice: Subject to any disclaimer, the term of this patent is extended or adjusted under 35 U.S.C. 154(b) by 0 days.

(21) Appl. No.: 13/966,199

(22) Filed: Aug. 13, 2013

(65) Prior Publication Data

US 2014/0047969 A1 Feb. 20, 2014

Related U.S. Application Data

(60) Provisional application No. 61/742,605, filed on Aug. 15, 2012.

(51) Int. Cl.
*G10C 3/12* (2006.01)

(52) U.S. Cl.
CPC ..... *G10C 3/12* (2013.01)
USPC ..... 84/423 R

(58) Field of Classification Search
USPC ..... 84/433, 438, 442, 441, 423 A, 423 R, 84/447–448, 423, 430
See application file for complete search history.

(56) References Cited

PUBLICATIONS

Shir, Gregory; "New Mozart Piano Aims to Revolutionize Piano Industry"; Overture; Dec. 2011; 1 pg.
PaganiniTechnique.com flyer, "Revolutionary Breakthrough for the Piano Industry!"; Oct. 2011; 1 pg.
Steinbuhler, David; "Our Research"; http://steinbuhler.com/html/our_research.html; 2013; 3 pgs.

*Primary Examiner* — Kimberly Lockett
(74) *Attorney, Agent, or Firm* — Michael Fedrick; Loza & Loza, LLP

(57) ABSTRACT

A keyboard instrument having keys modified as compared to a standard piano keyboard, in which the central longitudinal axis of the D♯ key extends between the adjoining distal lateral sides of the D and E keys, and in which the C♯ and D♯ keys, F♯ and G♯ keys, and G♯ and A♯ keys are respectively 17 millimeters apart.

13 Claims, 5 Drawing Sheets

PIANO KEY SYSTEM

CROSS-REFERENCE TO RELATED APPLICATIONS

The present application claims the benefit of priority under 35 U.S.C. §120 to U.S. Patent Application No. 61/742,605, filed on Aug. 15, 2012, the disclosure of which is incorporated herein by reference in its entirety.

BACKGROUND

The piano is a musical instrument played by depressing keys laid out sequentially on a keyboard. In traditional pianos, pressing a key causes a felt-covered hammer to strike steel strings and thereby produce a pitched tone. The hammers rebound, allowing the strings to continue vibrating at their resonant frequency, and these vibrations are transmitted through a bridge to a sounding board that amplifies the volume of the sound.

In electronic instruments having keyboards, pressing a key results in the playing of a predetermined sound associated with that key by the electronic instrument.

The layout of keys on a piano keyboard has been standardized in order to allow players to more easily play repertoire learned on different instruments. The spacing between the keys of a standard piano has changed little since the $18^{th}$ century.

SUMMARY

Despite modern advances in piano manufacturing over the past 160 years, the pattern of keys on piano keyboards has remained the same. Any student of the piano will attest that piano fingering on standard piano keyboards can sometimes be difficult, and that changes to standard keyboard layouts which make such fingering easier would be welcome. The present key system takes into account the layout of piano keys and the human hand, and facilitates piano fingering by providing a new layout of keys on a keyboard.

The present invention generally comprises a musical instrument having a keyboard (10) comprising keys (15) which preferably span at least two octaves, with each octave including keys for the notes A, A♯, B, C, C♯, D, D♯, E, F, F♯, G, and G♯ in order of ascending pitch. In each octave, proximal playing keys (40), generally referred to as "black keys," are provided for the notes C♯, D♯, F♯, G♯, and A♯. Each of the proximal playing key comprises a key top (12) having a proximal side (42), a distal side (44), a left lateral side (46), and a right lateral side (48), in which the right lateral side is parallel to the left lateral side and a longitudinal axis extends between the left lateral side (46) and the right lateral side (48) equidistantly between the left lateral side and the right lateral side. Each octave further includes distal playing keys (20), generally referred to as "white keys," for the notes A, B, C, D, E, F, and G. Each of the distal playing key comprises a key top (12) having a proximal side (22), a distal side (24), a left lateral side (26), and a right lateral side (28), the distal side (24) of each distal playing key extending longitudinally further than the distal side (44) of each proximal playing key. Preferably, the distal side (24) of each distal playing key is 22.5 millimeters in length.

In the present keyboard design, the left lateral sides (26) of the distal playing keys (20) for the notes A, B, D, E, and G each comprise a longitudinally extending proximal portion (32), a laterally extending medial portion (33), and a longitudinally extending distal portion (34). The right lateral sides (28) of the distal playing keys (20) for the notes A, C, D, F, and G similarly each comprise a longitudinally extending proximal portion (36), a laterally extending medial portion (37), and a longitudinally extending distal portion (38). The medial portion (37) of the right lateral side of the D key is the same length as the medial portion (33) of the left lateral side of the E key such that the longitudinal axis of the D♯ key extends between the longitudinally extending distal portion of the right lateral side of the D key and the longitudinally extending distal portion of the left lateral side of the E key. This is similar to the standard relationship between the A and G keys, in which the medial portion (37) of the right lateral side of the G key is the same length as the medial portion (33) of the left lateral side of the A key such that the longitudinal axis (60) of the G♯ key extends between the longitudinally extending distal portion (38) of the right lateral side of the G key and the longitudinally extending distal portion (34) of the left lateral side of the A key.

In order to facilitate playing of the portions of the distal playing keys (20) which lie between the proximal playing keys (40), the right lateral side (48) of the C♯ key is preferably 17 millimeters from the left lateral side (46) of the adjoining D♯ key, the right lateral side (48) of the F♯ key is preferably 17 millimeters from the left lateral side (46) of the adjoining G♯ key, and the right lateral side (48) of the G♯ key is preferably 17 millimeters from the left lateral side (46) of the adjoining A♯ key. Preferably, the right lateral side of each proximal playing key is 11.5 millimeters from the left lateral side. In a preferred embodiment, the medial portion (37) of the right lateral side of the C key is 9 millimeters in length and the medial portion (33) of the left lateral side of the D key is 3 millimeters in length; the medial portion (37) of the right lateral side of the F key is 9 millimeters in length and the medial portion (33) of the left lateral side of the G key is 3 millimeters in length; and the medial portion (37) of the right lateral side of the A key is 3 millimeters in length and the medial portion (33) of the left lateral side of the B key is 9 millimeters in length.

The present musical instrument can be a standard piano, in which each of the distal playing keys (20) and proximal playing keys (40) are mechanically connected to a hammer, and depressing one of the distal playing keys or proximal playing keys causes a hammer to strike a steel string. Alternatively, the musical instrument can produce sound electronically, in which case depressing one of the distal playing keys or proximal playing keys results in production of sound by electronic means.

FIGURES

DESCRIPTION

Definitions

Figure 1:
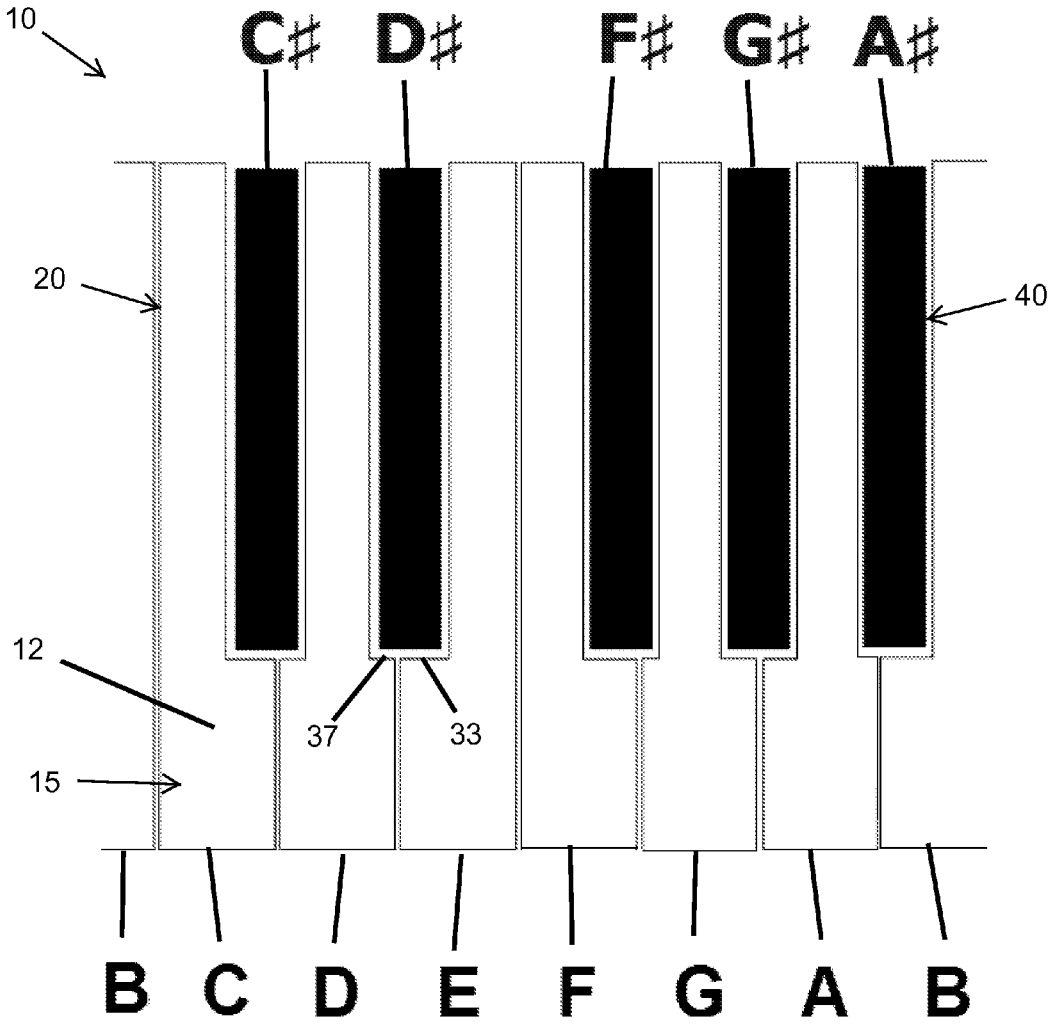
FIG. 1 is a top plan view of keys as laid out on a standard piano.

As used herein, the following terms and variations thereof have the meanings given below, unless a different meaning is clearly intended by the context in which such term is used.

"♯" after a referenced pitch (e.g., A, B, C, etc.) denotes a pitch which is a semitone higher than the referenced pitch, i.e. is "sharp."

"Adjoin" and "adjacent" mean next to. When a black key is said to adjoin another black key, a white key is located between the two black keys.

"Black keys" refer to the proximally positioned keys used to play C♯, D♯, F♯, G♯, and A♯ in a standard piano. Such keys are generally vertically raised with respect to the white keys of a piano, and can also be colors other than black.

"Horizontal" refers to an orientation approximately parallel to (i.e., not substantially extending toward or away from) a support surface on which the present musical instrument is supported when in use.

"Key" refers to a generally longitudinally extending, horizontal actuator of a musical instrument such as a piano which produces sound of a predetermined frequency, pitch, and/or timbre when depressed.

"Keyboard" refers to a set of adjacent depressible keys on a musical instrument, such as a piano.

"Key top" refers to the generally flat, horizontal upper portion of a key.

"Octave" generally refers to the twelve pitches (A, A♯, B, C, C♯, D, D♯, E, F, F♯, G, and G♯) of a well-tempered instrument such as a standard piano which span the interval between one musical pitch and another with half or double its frequency.

"Parallel" as used herein refers to a relationship between two straight portions of a key which extend in the same direction but do not substantially diverge or converge. A parallel relationship can include a slight deviation from a parallel orientation, such as an angle of 10° or less toward or away from the parallel portion of the key, preferably 5° or less, more preferably 2° or less.

"Standard piano" refers to current full-sized pianos, such as grand pianos and upright pianos.

"Standard piano keyboard layout" and variations thereof refer to the order and arrangement of black and white keys of a standard piano.

"White keys" refer to the keys used to play the pitches A-G (without accidentals) in a standard piano. Such keys can be or comprise other colors. The width of the white keys of the present keyboard is preferably approximately the same, and is also preferably about the same width as is used in standard piano keyboards, i.e. about 22.5 millimeters.

The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise.

The pitches of the keys are denoted using standard notation, i.e. capitalized letters of the alphabet from A through G, with unsharped keys corresponding to the white keys of a keyboard and sharped keys corresponding to the black keys. It is to be understood that while standard pitches (e.g., the pitch A corresponding to 440 Hz) are preferred, other pitch choices may be used, and as such references to pitches are relative. As used herein, references to the notes C♯, D♯, F♯, G♯, A♯ shall be understood to correspond to D♭, E♭, G♭, A♭, and B♭, respectively, in well-tempered tuning of a standard twelve note octave.

Keyboards

Most modern pianos have 36 black keys and 52 white keys, for a total of 88 keys (seven octaves plus a minor third, from A0 to C8). Many older pianos only have 85 keys (seven octaves from A0 to A7), while some manufacturers extend the range further in one or both directions. The pitch, order, and general arrangement of the keys used in the present system is the same as for a standard piano keyboard, with white keys corresponding to scale pitches from A to G, and black keys corresponding to the scale pitches C♯, D♯, F♯, G♯, A♯ as in a standard piano. As in standard piano keyboards, the distal extent (furthest from the body of a standard piano, but closest to a player of the piano) of the black keys in the present keyboard layout is positioned proximally (further from the player) with respect to the distal extent of the white keys. The upper surface of the black keys is also generally raised (further from a floor or other support surface) with respect to the upper surface of the white keys.

Figure 2:
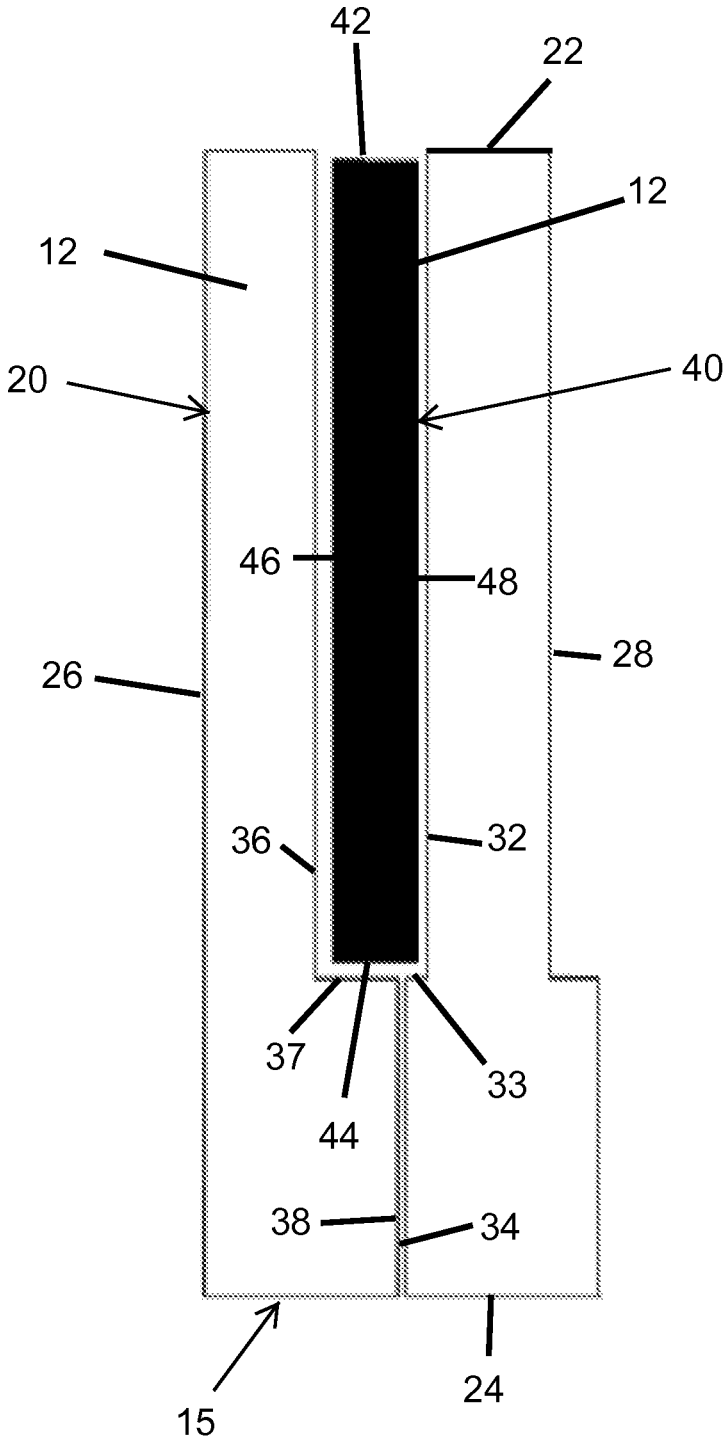
FIG. 2 is a top plan view of keys on a keyboard.
Figure 3:
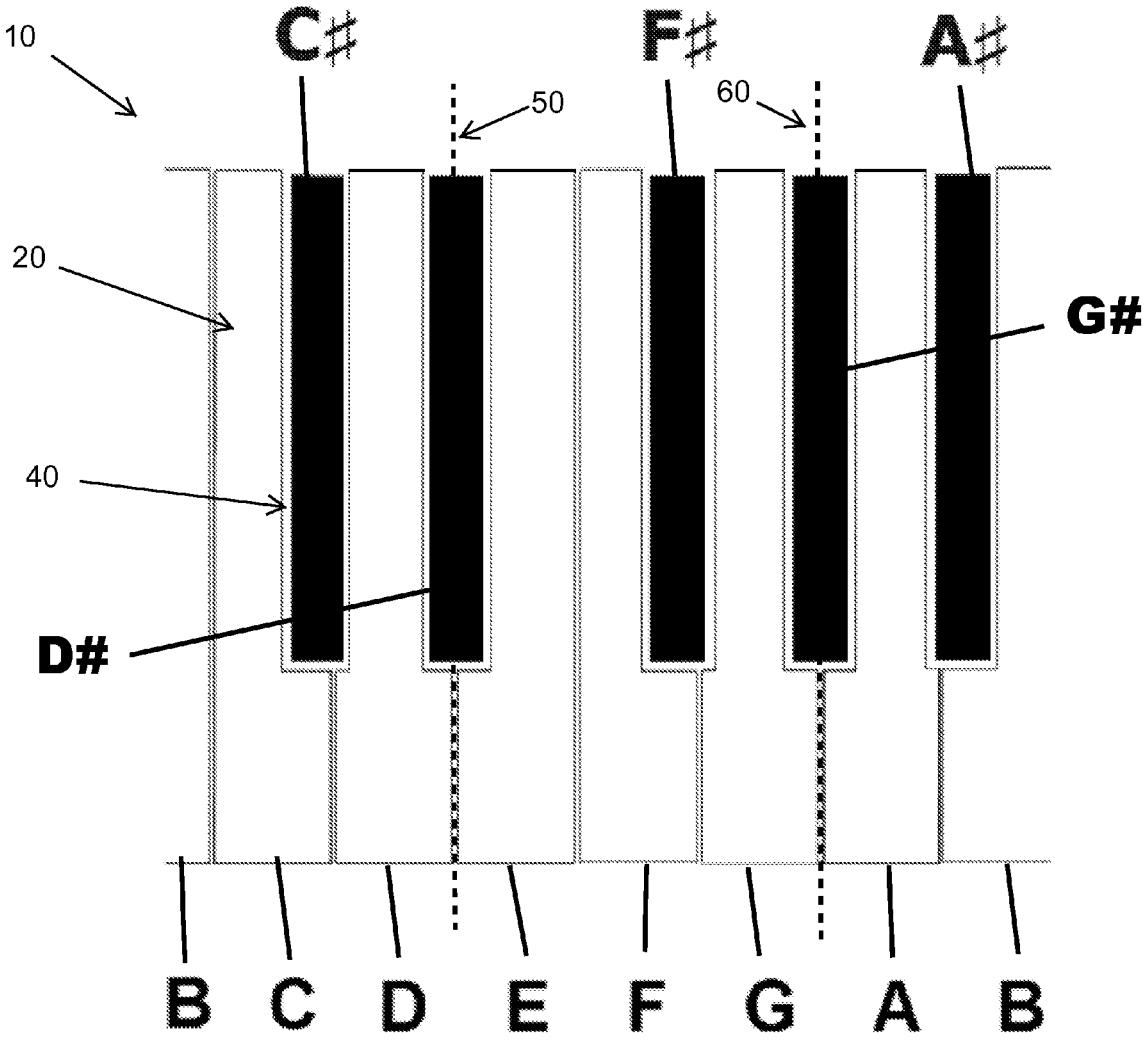
FIG. 3 is a top plan view of the presently disclosed keyboard.
Figure 4:
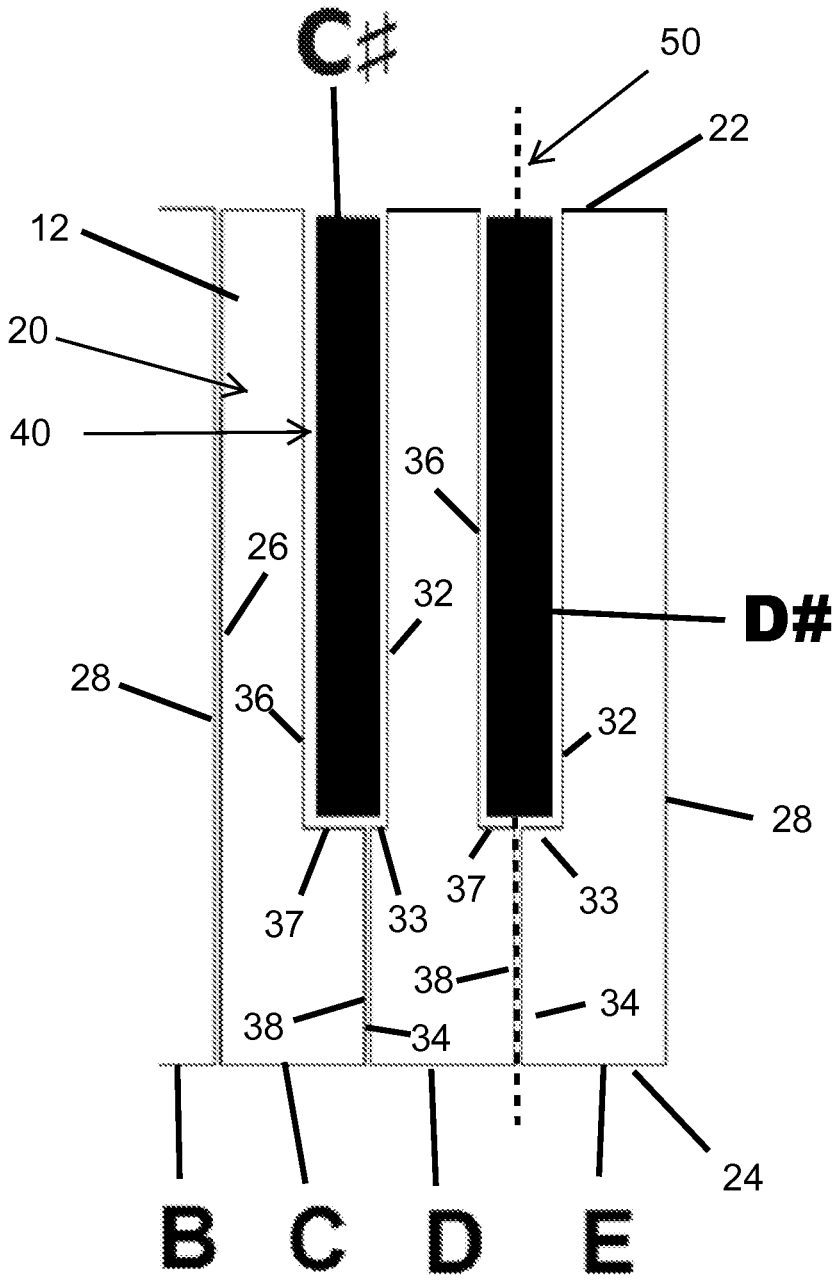
FIG. 4 is a top plan view of a portion of the keyboard of FIG. 3, including the keys C, C♯, D, D♯ and E.
Figure 5:
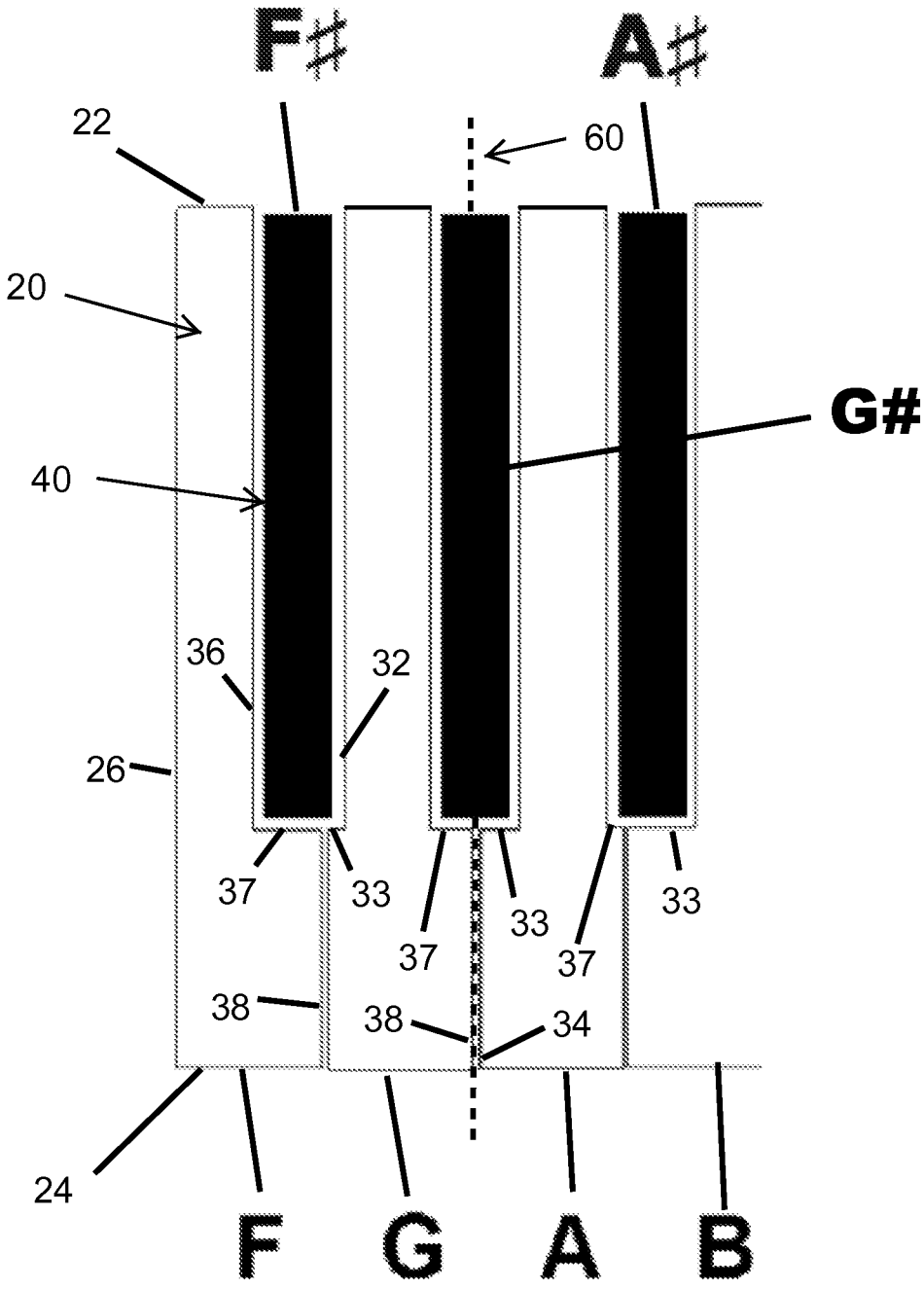
FIG. 5 is a top plan view of another portion of the keyboard of FIG. 3, including the keys F, F♯, G, G♯, A, A♯ and B.

The present invention generally comprises a musical instrument having a keyboard 10 comprising keys 15 which preferably span at least two octaves, with each octave including keys for the notes A, A♯, B, C, C♯, D, D♯, E, F, F♯, G, and G♯ in order of ascending pitch, with each of the foregoing pitches corresponding to a semitone (half step). In each octave, proximal playing keys 40, generally referred to as "black keys," are provided for the notes C♯, D♯, F♯, G♯, and A♯. As can be seen for example in FIG. 2, each of the proximal playing keys 40 comprises a key top 12 having a proximal side 42, a distal side 44, a left lateral side 46, and a right lateral side 48, in which the right lateral side 48 is parallel to the left lateral side 46 and a longitudinal axis (such as the longitudinal axes 50 and 60, shown in FIG. 3) extends between the left lateral side 46 and the right lateral side 48 equidistantly between the left lateral side 46 and the right lateral side 48. The proximal side 42 and distal side 44 of each proximal playing key 40 are preferably joined to the left lateral side 46 and the right lateral side 48 of the key at approximately right angles. The distal side of the proximal playing keys 40 is generally about 11 millimeters (11-11.5 mm) long, while the proximal side can be shorter, such as about 9 millimeters in length.

Each octave further includes distal playing keys 20, generally referred to as "white keys," for the notes A, B, C, D, E, F, and G. Each of the distal playing keys 20 comprises a key top 12 having a proximal side 22, a distal side 24, a left lateral side 26, and a right lateral side 28, the distal side 24 of each distal playing key extending longitudinally further than the distal side 44 of each proximal playing key. Preferably, the distal side 24 of each distal playing key is 22.5 millimeters in length. The distal portions of the white keys in the present design, as in standard piano keyboards, are directly adjacent to each other, and are separated by from each other at their distal ends by a space or gap of about 1 millimeter.

In the present keyboard design, the left lateral sides 46 of the distal playing keys 20 for the notes A, B, D, E, and G each comprise a longitudinally extending proximal portion 32, a laterally extending medial portion 33, and a longitudinally extending distal portion 34. The right lateral sides of the distal playing keys 20 for the notes A, C, D, F, and G similarly each comprise a longitudinally extending proximal portion 36, a laterally extending medial portion 37, and a longitudinally extending distal portion 38. As can be seen in FIGS. 2-5, the medial portions 33 and 37 are adjacent to and generally parallel with the distal sides 44 of the proximal keys 40. The medial portions 33 and 37 also preferably join their respective longitudinally extending proximal portions (32, 36) and longitudinally extending distal portions (34, 38) at right angles, as illustrated in the figures.

The left proximal portion 36, left medial portion 37, right medial portion 33, and right proximal portion 32 of adjacent white keys (i.e., the C and D, D and E, F and G, G and A, and A and B keys) together form a space within which respective black keys are positioned. Preferably, a distance of about 1 millimeter separates the left lateral side 46 of a proximal playing key (black key) 40 from the right proximal portion 36 of an adjacent white key 20, and likewise the right lateral side 48 of the black key 40 is preferably 1 millimeter from the left proximal portion 32 of the adjacent white key 20. The medial portions 33 and 37 of such adjacent white keys 20 are similarly about 1 millimeter from the distal side 44 of the adjacent proximal key 40.

In standard piano keyboards, the right medial portion 37 of the D key is shorter than the left medial portion 33 of the E key. In the present keyboard, however, the medial portion 37 of the right lateral side 28 of the D key is the same length as the medial portion 33 of the left lateral side 26 of the E key, such that the longitudinal axis 50 of the D♯ key generally extends between the longitudinally extending distal portion 38 of the right lateral side 28 of the D key and the longitudinally extending distal portion 34 of the left lateral side 26 of the E key. This is similar to the standard relationship between the A and G keys, in which the medial portion 37 of the right lateral side 28 of the G key is the same length as the medial portion 33 of the left lateral side 26 of the A key such that the longitudinal axis 60 of the G♯ key extends between the longitudinally extending distal portion 38 of the right lateral side 28 of the G key and the longitudinally extending distal portion 34 of the left lateral side 26 of the A key. This placement of the D♯ key shifts its longitudinal center leftward (toward the lower-pitched keys and further from the F♯ key) on a keyboard as compared to its placement on a standard piano. Preferably, the medial portion 37 of the right lateral side 28 of the D key and the medial portion 33 of the left lateral side 26 of the E key are each 6 millimeters in length, and are separated by a gap of 1 millimeter, thereby forming a space for the D♯ key which is 13 millimeters wide (i.e., 13 millimeters between the right proximal portion 36 of the D key and the left proximal portion 32 of the E key). The medial portion 37 of the right lateral side 28 of the G key and the medial portion 33 of the left lateral side 26 of the A key are likewise preferably each 6 millimeters in length, and are separated by a gap of 1 millimeter. Preferably, the distance between the longitudinal axis of the A♯ key and the longitudinal axis of the C♯ key is 41 millimeters, and the distance between the longitudinal axis of the D♯ key and the longitudinal axis of the F♯ key is 44 millimeters. The distance between the right proximal portion 36 and the left proximal portion 32 of the C and D keys, D and E keys, the F and G keys, the G and A keys, and the A and B keys, respectively, is likewise preferably 13 millimeters.

In addition, the right lateral side 48 of the C♯ key is preferably 17 millimeters from the left lateral side 46 of the adjoining D♯ key, at least at the distal end of the key (since black keys sometimes taper toward the proximal side). This distance is wider than the 16½ millimeters of standard keyboards, and facilitates playing the portions of the distal playing keys 20 which lie between the proximal playing keys 40. The right lateral side 48 of the F♯ key is likewise preferably 17 millimeters from the left lateral side 46 of the adjoining G♯ key, and the right lateral side 48 of the G♯ key is also preferably 17 millimeters from the left lateral side 46 of the adjoining A♯ key, for the same reason. Providing such additional space on a keyboard between the black keys can be facilitated by using proximal playing keys 40 (black keys) having a width of 11 millimeters, i.e. such that the right lateral side 48 of the proximal playing key is 11 millimeters from the left lateral side 46. In a preferred embodiment, the medial portion 37 of the right lateral side of the C key is 9 millimeters in length and the medial portion 33 of the left lateral side of the D key is 3 millimeters in length; the medial portion 37 of the right lateral side of the F key is 9 millimeters in length and the medial portion 33 of the left lateral side of the G key is 3 millimeters in length; and the medial portion 37 of the right lateral side of the A key is 3 millimeters in length and the medial portion 33 of the left lateral side of the B key is 9 millimeters in length.

In a preferred embodiment, the distance between the right proximal side 36 and the left lateral side 26 of the C and F keys is 13.5 millimeters, and the distance between the left proximal side 32 and the right lateral side 28 of the B key is likewise 13.5 millimeters. In addition, the distance between the left proximal side 32 and the right proximal side 36 of the D, G, and A keys is preferably 15 millimeters. The distance between the left proximal side 32 and the right lateral side 28 of the E is preferably 16.5 millimeters.

In the present keyboard design, the longitudinal axis 60 of the G♯ key remains centered between the G and A keys, i.e. generally between the right longitudinally extending distal portion 38 and the left longitudinally extending distal portion 34. Providing approximately 17 millimeters between the sides of adjacent black keys therefore shifts the F♯ key further leftward on the keyboard (toward the lower-pitched keys) and shifts the A♯ key further rightward on the keyboard (toward the higher-pitched keys) as compared with a standard piano.

The main effect of the foregoing changes is to shift the D♯ key leftward on a keyboard as compared to its placement on a standard piano and to establish more space between the black keys, preferably about 17 millimeters. This makes the keyboard easier to play and improves the experience of an individual playing the piano.

Musical Instruments

The present keyboard can be used with any of a number of different musical instruments played using a keyboard. This includes all pianos, such as pianos of traditional design (e.g., grand pianos), upright pianos, electric pianos, and toy pianos. The present system can also be applied to other keyboard instruments, including organs, accordions, hurdy-gurdies, and plucked keyboard instruments such as the harpsichord. Electronic instruments such as digital pianos, digital guitars, and synthesizers can also make use of the present keyboard design.

When applied to acoustic pianos (e.g., grand pianos and upright pianos), the present piano fingering system does not substantially alter the structural portions of the piano involved in sound production. Depending on the placement of strings relative to the keys of the present keyboard layout, some mechanical changes may be needed in order to effect the striking of a string by a hammer associated with a particular key. Such mechanical changes are within the skill of one of skill in the art of producing pianos.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference in their entirety.

What is claimed is:

1. A musical instrument having a keyboard comprising a plurality of keys, the keys comprising at least two octaves with each octave including keys for the notes A, A♯, B, C, C♯, D, D♯, E, F, F♯, G, and G♯ in order of ascending pitch, wherein each octave comprises:

proximal playing keys for the notes C♯, D♯, F♯, G♯, A♯ in order of ascending pitch, wherein each proximal playing key comprises a key top having a proximal side, a distal side, a right lateral side, and a left lateral side, wherein the right lateral side of each proximal playing key is parallel to the left lateral side of the proximal playing key, and wherein a longitudinal axis extends between the left lateral side and the right lateral side of each proximal playing key equidistantly between the left lateral side and the right lateral side; and distal playing keys for the notes A, B, C, D, E, F, and G in order of ascending pitch, wherein each distal playing key comprises a key top having a proximal side, a distal side, a right lateral side, and a left lateral side, the distal side of each distal playing key extending longitudinally further than the distal side of each proximal playing key, wherein the left lateral sides of the distal playing keys for the notes A, B, D, E, and G each comprise a longitudinally extending proximal portion, a laterally extending medial portion, and a longitudinally extending distal portion, wherein the right lateral sides of the distal playing keys for the notes A, C, D, F, and G each comprise a longitudinally extending proximal portion, a laterally extending medial portion, and a longitudinally extending distal portion, and wherein the medial portion of the right lateral side of the D key is the same length as the medial portion of the left lateral side of the E key, such that the longitudinal axis of the D♯ key extends between the longitudinally extending distal portion of the right lateral side of the D key and the longitudinally extending distal portion of the left lateral side of the E key.

2. The keyboard of claim 1, wherein the right lateral side of the C♯ key adjacent the distal side of the C♯ key is 17 millimeters from the left lateral side of the adjoining D♯ key adjacent the distal side of the D♯ key, the right lateral side of the F♯ key adjacent the distal side of the F♯ key is 17 millimeters from the left lateral side of the adjoining G♯ key adjacent the distal side of the G♯ key, and the right lateral side of the G♯ key adjacent the distal side of the G♯ key is 17 millimeters from the left lateral side of the adjoining A♯ key adjacent the distal side of the A♯ key.

3. The keyboard of claim 1, wherein the medial portion of the right lateral side of the C key is 9 millimeters in length, and the medial portion of the left lateral side of the D key is 3 millimeters in length.

4. The keyboard of claim 1, wherein the medial portion of the right lateral side of the F key is 9 millimeters in length, and the medial portion of the left lateral side of the G key is 3 millimeters in length.

5. The keyboard of claim 1, wherein the medial portion of the right lateral side of the A key is 3 millimeters in length, and the medial portion of the left lateral side of the B key is 9 ml millimeters in length.

6. The keyboard of claim 1, wherein the distal side of each distal playing key is 22.5 millimeters in length.

7. The keyboard of claim 1, wherein the distal side of each proximal playing key is 11 millimeters long.

8. The keyboard of claim 1, wherein the medial portion of the right lateral side of the G key is the same length as the medial portion of the left lateral side of the A key such that the longitudinal axis of the G♯ key extends between the longitudinally extending distal portion of the right lateral side of the G key and the longitudinally extending distal portion of the left lateral side of the A key.

9. The keyboard of claim 1, wherein each of the distal playing keys and proximal playing keys are mechanically connected to a hammer, and wherein depressing one of the distal playing keys or proximal playing keys causes a hammer to strike a steel string.

10. The keyboard of claim 1, wherein the musical instrument produces sound electronically, and wherein depressing one of the distal playing keys or proximal playing keys results in production of sound.

11. The keyboard of claim 1, wherein the longitudinal axis between the A♯ key and the C♯ key is 41 millimeters.

12. The keyboard of claim 1, wherein the keys comprise at least four octaves.

13. A musical instrument having a keyboard comprising a plurality of keys, the keys comprising at least two octaves with each octave including keys for the notes A, A♯, B, C, C♯, D, D♯, E, F, F♯, G, and G♯ in order of ascending pitch, wherein each octave comprises:

proximal playing keys for the notes C♯, D♯, F♯, G♯, A♯ in order of ascending pitch, wherein each proximal playing key comprises a key top having a proximal side, a distal side, a right lateral side, and a left lateral side, wherein the right lateral side of each proximal playing key is parallel to the left lateral side of the proximal playing key, and wherein a longitudinal axis extends between the left lateral side and the right lateral side of each proximal playing key equidistantly between the left lateral side and the right lateral side; and distal playing keys for the notes A, B, C, D, E, F, and G in order of ascending pitch, wherein each distal playing key comprises a key top having a proximal side, a distal side, a right lateral side, and a left lateral side, the distal side of each distal playing key extending longitudinally further than the distal side of each proximal playing key, wherein the left lateral sides of the distal playing keys for the notes A, B, D, E, and G each comprise a longitudinally extending proximal portion, a laterally extending medial portion, and a longitudinally extending distal portion, wherein the right lateral sides of the distal playing keys for the notes A, C, D, F, and G each comprise a longitudinally extending proximal portion, a laterally extending medial portion, and a longitudinally extending distal portion, wherein the right lateral side of the C♯ key adjacent the distal side of the C♯ key is 17 millimeters from the left lateral side of the adjoining D♯ key adjacent the distal side of the D♯ key, the right lateral side of the F♯ key adjacent the distal side of the F♯ key is 17 millimeters from the left lateral side of the adjoining G♯ key adjacent the distal side of the G♯ key, and the right lateral side of the G♯ key adjacent the distal side of the G♯ key is 17 millimeters from the left lateral side of the adjoining A♯ key adjacent the distal side of the A♯ key, wherein the medial portion of the right lateral side of the D key is the same length as the medial portion of the left lateral side of the E key such that the longitudinal axis of the D♯ key extends between the longitudinally extending distal portion of the right lateral side of the D key and the longitudinally extending distal portion of the left lateral side of the E key, and wherein the distal side of each proximal playing key is 11 millimeters long.

* * * * *